US008176585B1

(12) United States Patent
Isham

(10) Patent No.: US 8,176,585 B1
(45) Date of Patent: May 15, 2012

(54) EXTERNAL IMMOBILIZER

(75) Inventor: John Isham, Houston, TX (US)

(73) Assignee: RadiaDyne LLC, Houston, TX (US)

( * ) Notice: Subject to any disclaimer, the term of this patent is extended or adjusted under 35 U.S.C. 154(b) by 370 days.

(21) Appl. No.: 12/430,655

(22) Filed: Apr. 27, 2009

Related U.S. Application Data

(60) Provisional application No. 61/047,973, filed on Apr. 25, 2008.

(51) Int. Cl.
*A47C 27/10* (2006.01)

(52) U.S. Cl. ..... 5/621; 5/632; 5/710

(58) Field of Classification Search ..... 5/630, 632, 5/710, 722, 733–734, 621
See application file for complete search history.

(56) References Cited

U.S. PATENT DOCUMENTS

| | | | | |
|---|---|---|---|---|
| 4,584,730 | A | 4/1986 | Rajan | |
| 4,893,367 | A | 1/1990 | Heimreid et al. | |
| 5,522,103 | A | 6/1996 | Kier et al. | |
| 5,742,963 | A * | 4/1998 | Trevino et al. | 5/632 |
| 5,815,862 | A * | 10/1998 | Rygiel | 5/632 |
| 5,832,550 | A | 11/1998 | Hauger et al. | |
| 6,327,724 | B1 | 12/2001 | Sharrock et al. | |
| 7,216,385 | B2 | 5/2007 | Hill | |

* cited by examiner

*Primary Examiner* — Fredrick Conley
(74) *Attorney, Agent, or Firm* — Boulware & Valoir

(57) ABSTRACT

An external immobilizer for cancer treatment has a foot section with at least one inflatable bladder therein, a knee section connected to an end of the foot section, a pelvic section connected to an end of the knee section opposite the foot section, and an inflation device. The knee section has an elevated surface thereon. The pelvic section has at least one inflatable bladder cooperative with a surface thereof. The inflation device is cooperative with the foot section and the pelvic section and is used to selectively inflate the bladders of the foot section and the pelvic section.

8 Claims, 3 Drawing Sheets

EXTERNAL IMMOBILIZER

RELATED U.S. APPLICATIONS

The present application claims priority from U.S. Provisional Patent Application Ser. No. 61/047,973, filed on Apr. 25, 2008, and entitled "EXTERNAL IMMOBILIZER."

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention is related to apparatuses for immobilizing a patient during treatment of cancer and other diseases. More particularly, the present invention relates to immobilizers having a number of sections. More particularly still, the present invention is related to immobilizers that have inflatable bladders in the sections of the immobilizer.

2. Description of Related Art Including Information Disclosed Under 37 CFR 1.97 and 37 CFR 1.98.

Cancer is an ailment affecting thousands of Americans every year. Various forms of treatment of cancer exist, including radiation treatment. Radiation treatment can be external, internal or systematic. In external radiation treatment, radiation that destroys cancer cells comes from a machine outside the body of a patient. The machine is directed to the cancerous region of the patient and radioactive particles are shot into the body of the patient. The radioactive particles destroy both healthy and cancerous tissues. Thus, a patient treated with external radiation therapy will have wounds that must heal due to the destruction of healthy and cancerous tissues during external radiation treatment.

Internal radiation treatment uses radiation that is placed inside the patient's body or inside cancerous tissue. The radiation is in the form of radioactive materials that are contained in an implant. The implant is placed directly in the body of the patient. Thus, in internal radiation treatment, part of the patient is radioactive where the implant is located, and care must be taken not to expose care givers and others to radiation.

In systematic radiation treatment, radiative materials such as iodine 131 and strontium 89 are ingested by the patient or injected into the body of the patient. Thus, the radiative materials travel throughout the body of the patient, making the patient radioactive. In systemic radiation treatment, great care must be taken not to expose others to the radiation that is contained within the patient's body.

One alternative to using radiation treatment is to use external-beam treatment to kill cancerous cells in a patient. External beam treatment uses high-intensity light to shrink or destroy cancerous tissues. In addition to eliminating exposure to radiation of the patient, external beams allow one to pinpoint the cancerous tissues within the body of the patient and destroy only the cancerous tissues. Thus, healthy cells are not destroyed while destroying cancerous tissues. Moreover, neither the patient nor anyone else is exposed to any sort of radiation during external beam treatment of cancer.

In order to pinpoint cancerous tissues within the body of a patient, the patient must be placed in a fixed position. This fixed location must be repeated for every treatment session so as to repeatedly attack the pinpointed regions of cancerous tissue. In external beam treatment, it is important that the same regions are pinpointed in each successive treatment session. Current methods of external beam treatment for cancer use moldable cushions that are custom-made for each patient. These moldable cushions create several problems. First, the cushions take up a large amount of physical space. Because the cushions are custom-made for each patient, this use of a large space is magnified because the number of cushions needed is multiplied each time a new patient needs external beam treatment for cancer. Another problem with moldable cushions is that they are not effective in keeping the patient in a fixed position over multiple sessions because the cushions have wiggle room. Thus, a patient may be in a slightly different position in one session than another, which can cause great difficulties in the treatment with external beams. Additionally, the moldable cushions do not account for weight loss or weight gain by the patient between treatment sessions. Thus, if a patient has gained or lost weight between one session and another, the cushion will put the patient in a position different from the previous session that will effect the external beam treatment of cancer. Thus, a need has arisen for a patient immobilizing apparatus that has the ability to fix a patient in the same location over multiple sessions of treatment regardless of weight loss or weight gain.

Various patents have issued relating to patient immobilizers. For example, U.S. Pat. No. 7,216,385, issued on May 15, 2007 to Hill, discloses an inflatable cushion for use in a system and method in supporting the knees and legs of a person during surgery that includes an inflatable bladder that can move from a collapsed state to an expanded state. A bladder port communicates with a source of inflating fluid. The system includes the source of pressurized fluid and a valve assembly to switchably control the inflation and deflation of the bladder. The bladder may have a removable cover extending around the bladder, and the bladder may have side pleats to assist in expanding with the cover having corresponding accordion folds. The method involves placing a patient on a surgical table, decompressing the patient's spine to a flat back/drop knee position, interposing the bladder between the table and the patient's knees and advancing the knees to a full prone position by inflating the bladder.

U.S. Pat. No. 4,893,367, issued on Jan. 16, 1990 to Heimreid et al., discloses a system of separately adjustable pillows that is characterized by separately inflatable and deflatable containers which may be emptied or filled from a connected source with a pressurized fluid, via a manifold which is provided with valves for each container.

U.S. Pat. No. 6,327,724, issued on Dec. 11, 2001 to Sharrock et al., discloses an inflatable positioning device that includes a pump, a tube extending from the pump, a valve intermediate the length of the tube and a non-rectangular inflatable pillow connected to the end of the tube remote from the pump. The non-rectangular inflatable pillow is dimensioned for positioning portions of a patient's body during surgery.

U.S. Pat. No. 5,522,103, issued on Jun. 4, 1996 to Kier et al., discloses a system for supporting a bed-ridden patient while that patient uses a bed pan that includes a body-supporting section and a foot-supporting section which co-operate so as to maintain a proper and desired relative orientation among the patient's legs, hips and spine. The body-supporting section is inflatable, and the fully-inflated height of the body-supporting section is greater than the height of the foot-supporting section to provide versatility to the system. The body-supporting section is coated with lubricant to facilitate sliding that section under a patient.

U.S. Pat. No. 4,584,730, issued on Apr. 29, 1986 to Rajan, discloses a device for stabilizing the pelvis of a lying patient in a preselected angular position relative to a conventional flat bed that includes a generally disc-shaped body with two basically parallel planar surfaces. The body is intended to be placed between the lower extremities of the patient and is designed with a cavity, which extends from the edge of the body toward its center and conforms to and is somewhat bigger than the contours of the patient's pelvis as seen from the side, and has parts protruding from the respective planar surfaces, and preferably arranged in pairs on opposite sides of the body. The protruding parts are arranged to support the body far enough above the bed to give room for one extremity between the bed and the planar surface facing the bed while the other extremity rests on the opposite planar surface, thereby providing some moving space for the extremities between the protruding parts. In the cavity, supporting surfaces are arranged to support the lumbar region of the patient on one side and on the other side the hip bones of the patient, whereby the pelvis is stabilized essentially at a right angle to the bed.

U.S. Pat. No. 5,832,550, issued on Nov. 10, 1998 to Hauger et al., discloses a moldable vacuum cushion for positioning a patient during radiation therapy treatment that includes an indexing bar with indexing pins to allow the attached cushion to be quickly, easily, accurately, and repeatably indexed on a baseplate or treatment table. The indexing bar may be releasably mounted on a frame member fixed to the cushion or may be directly mounted on the cushion.

It is an object of the present invention to provide an apparatus that immobilizes a patient during cancer treatment.

It is another object of the present invention to provide an apparatus that more precisely places a patient during cancer treatment.

It is another object of the present invention to provide an apparatus that avoids problems of changes in femoral location of patients due to weight loss or weight gain.

It is still another object of the present invention to provide an apparatus that compensates for breathing of a patient during cancer treatment.

It is another object of the present invention to provide an apparatus that can precisely mold to the contours of the bodies of many different patients.

It is another object of the present invention to provide an apparatus that automatically fixes a patient in an immobile position with pneumatic and software devices.

These and other objects and advantages of the present invention will become apparent from a reading of the attached specification and appended claims.

BRIEF SUMMARY OF THE INVENTION

The present invention is an external immobilizer for use in cancer treatment having a foot section having at least one inflatable bladder therein, a knee section connected to an end of the foot section, a pelvic section connected to an end of the knee section opposite the foot section, and an inflating means cooperative with the foot section and the pelvic section. The inflating means selectively inflates the bladders of the foot section and the pelvic section. The knee section has an elevated surface thereon. The pelvic section has at least one inflatable bladder cooperative with a surface thereof. The pelvic section has a buttocks section having at least one inflatable bladder cooperative with a surface thereof and, a lower back section having at least one inflatable bladder cooperative with a surface thereof.

The external immobilizer also has a torso section connected to an end of the pelvic section opposite the knee section. The torso section has at least one inflatable bladder cooperative with a surface thereof. The foot section has a molded contour therein suitable for receiving the feet of a patient. The inflatable bladder of the foot section has a first inflatable bladder and a second inflatable bladder.

The knee section of the present invention has a first inclined surface and a second inclined surface extending toward an upper section thereof. Additionally, the knee section has molded contours therein suitable for receiving the legs of a patient. The pelvic section has molded contours therein suitable for receiving the buttocks and lower back of a patient. These molded contours are selectively inflatable by the inflating means so as to position the buttocks and lower back of a patient.

The inflating means has a plurality of actuating devices connected to the inflatable bladders of the foot section and the pelvic section, a plurality of fluid lines connected to the plurality of actuating devices, and a fluid supply device connected to the plurality of fluid lines at an end remote from the plurality of actuating devices. A computing means is connected to the plurality of actuating devices for actuating the actuating devices so as to selectively and independently inflate and deflate the inflatable bladders using a fluid supplied by the fluid supply device.

The present invention is also an external immobilizer for cancer treatment having a mat structure with contoured moldings formed therein, a plurality of bladders positioned on the mat structure adjacent the contoured moldings, a plurality of actuating devices connected to the plurality of bladders, a plurality of fluid supply lines connected to the actuating devices, and a fluid supplying means connected to the plurality of fluid supply lines remote from the plurality of actuating devices. The fluid supplying means selectively supplies fluid to the plurality of inflatable bladders. The mat structure has a foot section, a knee section connected to the foot section, and a body section connected to an end of the knee section opposite the foot section. The body section has a buttocks section, a lower back section connected to an end of the buttocks section, and a torso section connected to an end of the lower back section opposite the buttocks section. At least one of the plurality of bladders is inflatable so as to lock the feet of a patient within the foot section.

The present invention is also a method of immobilizing a patient for cancer treatment comprising the steps of: (a) forming a mat structure having contoured moldings formed therein and a plurality of inflatable bladders under the surface of the contoured moldings, each of the inflatable bladders having an actuating device connected thereto; (b) connecting the actuating devices through fluid supply lines to a fluid supply device; (c) placing a patient on the mat structure; and (d) selectively inflating the plurality of inflatable bladders so as to fix the patient in a desired position. The method further includes the steps of connecting the actuating devices and fluid supply device to a computer, and controlling the inflation of the plurality of inflatable bladders by the computer. The inflation and deflation of the plurality of inflatable bladders positioned below the torso may be coordinated so as to compensate for the heave fo the chest of the patient caused by breathing. A patient's weigh gain or loss may be compensated for during subsequent treatments by inflating the plurality of inflatable bladders to a greater or lesser degree.

DETAILED DESCRIPTION OF THE INVENTION

Figure 1:
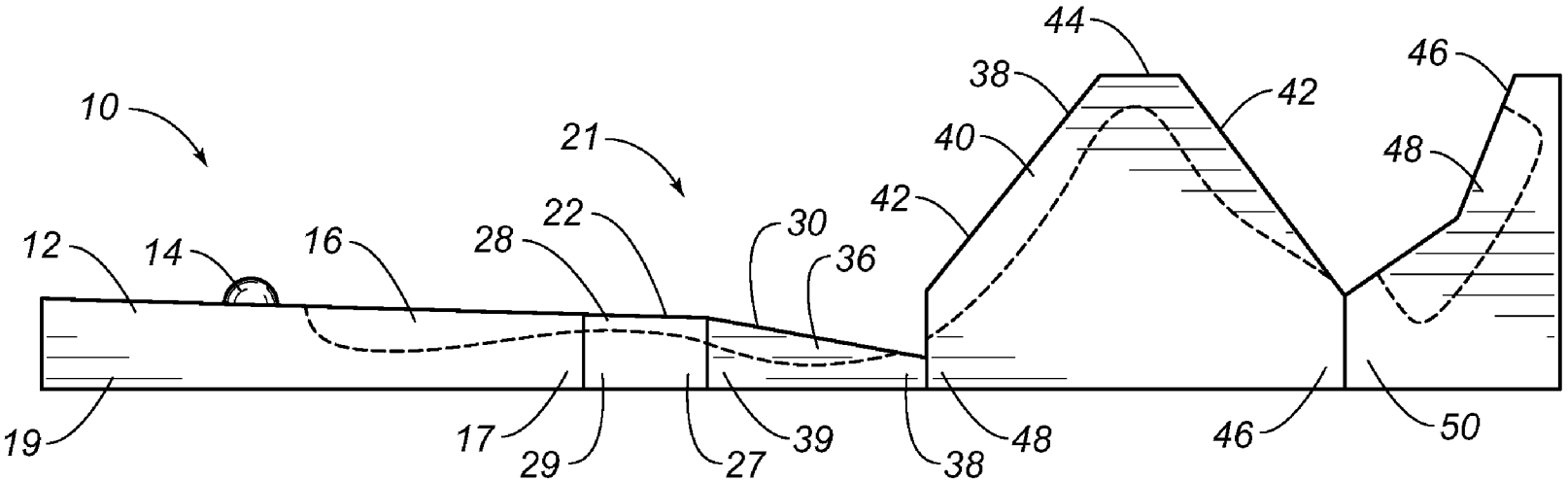
FIG. 1 shows an side elevation view of the external immobilizer of the present invention.

Referring to FIG. 1, there is shown the side elevation view of the external immobilizer 10 of the present invention. The foot section 46 has an end 50 connected to an end 46 of the knee section 38. The knee section 38 has an opposite end 48 connected to an end 38 of the buttocks section 30. The buttocks section 30 has an opposite end 39 connected to an end 27 of the lower back section 22. The lower back section 22 has an opposite end 29 connected to an end 17 of the torso section 12. Together, the buttocks section 30 and the lower back section 22 for the pelvic section 21.

The torso section 12 has a neck support 14 and an upper torso molding 16. The upper torso molding 16 is shown with dotted lines. The lower back section 22 has a lower torso molding 28. The lower torso molding 28 is shown with dotted lines. The buttocks section 30 has a buttocks molding 36. The buttocks molding 36 is shown with dotted lines. The knee section 38 has a leg molding 40. The leg molding 40 is shown with dotted lines. The knee section 38 has angled sides 42 that angle towards a plateau 44 where the knees of the patient rest. The foot section 46 has a foot molding 48. The foot molding 48 is shown with dotted lines.

As can be seen in FIG. 1, the torso section 12 angles downwardly from the opposite end 19 to the end 17. Likewise, the lower back section 22 angles downwardly from the opposite end 29 to the end 27. The buttocks section 30 also angles downwardly from the opposite end 39 to the end 38. Notably, the buttocks section 30 has a downward angle greater than the downward angle of the lower back section 22 and the torso section 12.

In the external immobilizer 10 of the present invention, a patient lies on his or her back so that the back side of his or her body is adjacent to the sections 12, 22, 30, 38, and 46 of the external immobilizer 10.

Figure 2:
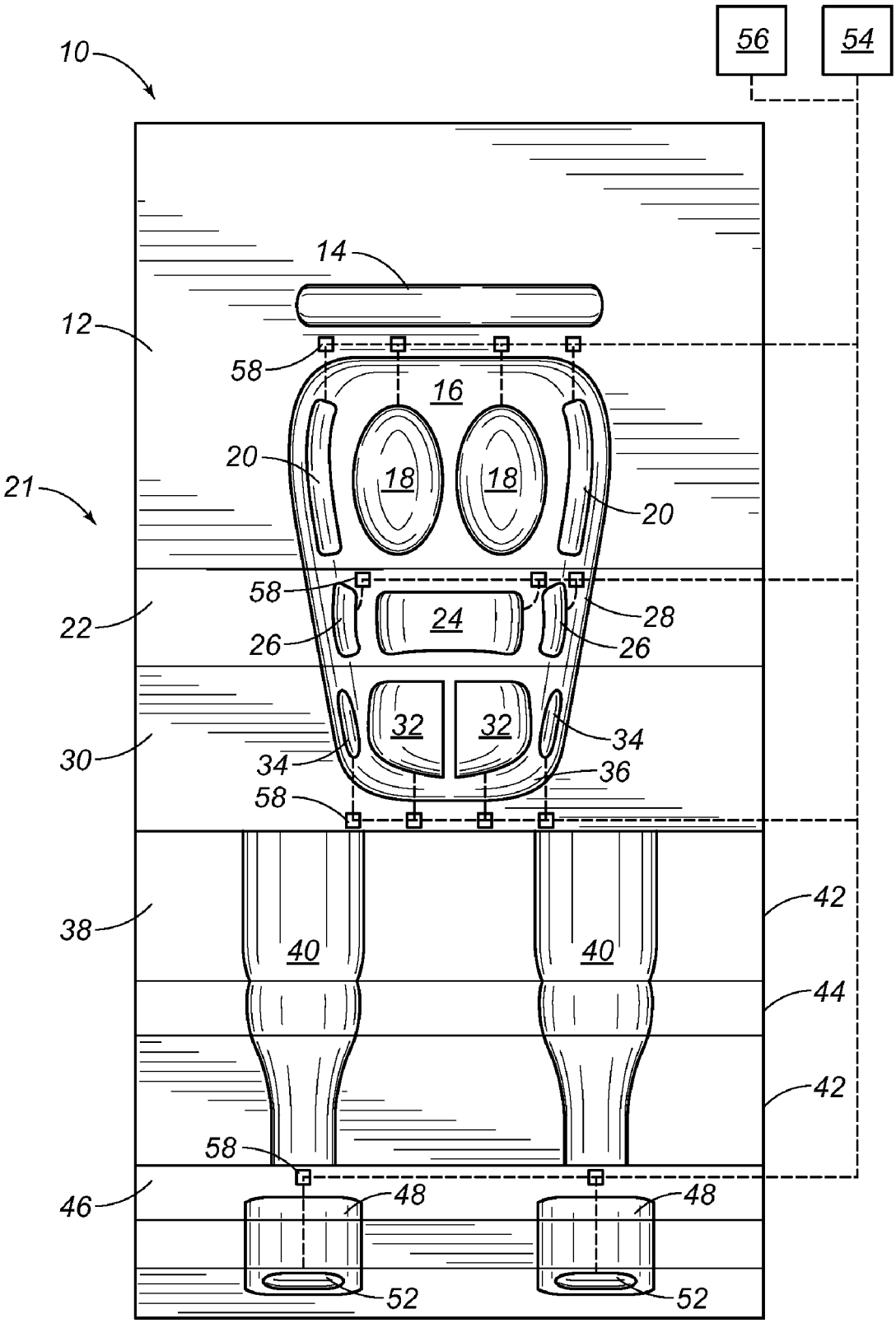
FIG. 2 shows a plan view of the external immobilizer of the present invention.

Referring to FIG. 2, there is shown a plan view of the external immobilizer 10 of the present invention. The torso section 12 has a neck support 14 and a upper torso molding 16. Inflatable bladders 18 and 20 are located in the upper torso molding 16. The bottom bladders 18 lie directly under the upper torso molding 16, and thus, they lie directly under the back of a patient. The side bladders 20 lie on the sides of the upper torso molding 16. The bottom bladders 18 inflate and deflate so as to move the patient up and down within the upper torso molding 16. The side bladders 20 inflate and deflate so as to move the patient from side to side and up and down. The inflation and deflation of the bladders 18 and 20 is controlled by a computer 56. The computer is electronically connected to actuating devices 58, which are actuated so as to allow a fluid to pass into and out of the bladders 18 and 20. A fluid is supplied by a fluid supply device 54.

The lower back section 22 has a lower torso molding 28. Under the torso molding 28 is a bottom bladder 24. On the sides of the lower torso molding 28 are side bladders 26. The bladders 24 and 26 are connected to actuating devices 58 that allow fluid to be supplied or withdrawn from the bladders by the fluid supply device 54. The actuating devices 58 are electronically connected to the computer 56 which electronically actuates the devices 58. The bladders 24 and 26 of the lower back section 22 can be inflated and deflated independently.

The buttocks section 30 has a buttocks molding 36. Under the buttocks molding 36 are bottom bladders 32. On the sides of the buttocks molding 36 are side bladders 34. The bladders 32 and 34 are connected to the actuating devices 58. Fluid is supplied to and from the bladders 32 and 34 by the fluid supply device 54. The actuating devices 58 are electronically connected to the computer 56 which controls the inflation and deflation of the bladders 32 and 34. The bottom bladders 32 can move a patient upwards and downwards within the molding 36. The side bladders 34 can move the patient up and down and sideways within the molding 36.

The knee section 38 has a leg molding 40 for each leg of the patient. The leg molding 40 travels up and down the angled side walls 42 of the knee section 38. The knees of the patient rest on the plateau 44 of the knee section 38.

The foot section 46 has a foot molding 48 for each of the feet of the patient. Inflatable and deflatable bladders 52 are located under the molding 48. The bladders 52 are connected to the actuating devices 58. The bladders are inflated and deflated by a fluid supply device 54. The actuating devices 58 are actuated by the computer 56.

The fluid supply lines and electronic lines that are connected between the fluid supply device 54 and the bladders 18, 20, 24, 26, 32, 34, and 52 and between computer 56 and actuating device 58, respectively, are shown as dotted lines in FIG. 2. Each of the bladders 18, 20, 24, 26, 32, 34, and 52 can be inflated or deflated independently of the other so as to position the patient in a certain position for cancer treatment.

The bladders 18, 20, 24, 26, 32, 34 and 52 of the external immobilizer 10 of the present invention can all inflate or deflate independently so as to pinpoint a position of a patient. The bladders 18, 20, 24, 26, 32, 34 and 52 thus can precisely position a patient in successive treatment sessions for cancer regardless of weight gain or weight loss of the patient. If weight has been gained in the thighs of a patient, the bladders 32 and 34 of the buttocks section 30 can be inflated and deflated so as to precisely position the femoral parts of the patient's body so as to create the same position of the patient as the previous treatment session.

Another unique aspect of the external immobilizer is the bladders 18 and 20 of the torso section 12. Patients must continuously breathe during cancer treatment, even external beam treatment. If treatment is in a region near the lungs, then fixing the position of the patient will be more difficult because the patient's body will continuously move up and down when the patient breathes. The present invention contemplates that the bladders 18 and 20 of the torso section 12 can be controllably inflated and deflated to compensate for the breathing of a patient during treatment. Thus, the bladders 18 and 20 are continuously inflated and deflated when the patient breathes in and out so as to keep the body of the patient in a constant position while the patient breathes during cancer treatment.

Another unique aspect of the present invention is that the bladders 18, 20, 24, 26, 32, 34 and 52 can be inflated and deflated so as to position the patient at an angle that would otherwise not be reachable by a treatment machine that is in the hospital. Thus, the present invention provides cancer treatment to a greater number of patients that would otherwise not be able to receive such treatment because a machine that would not be otherwise to reach a certain area of the body can now reach that area because the external immobilizer can position the patient in such a position.

Figure 3:
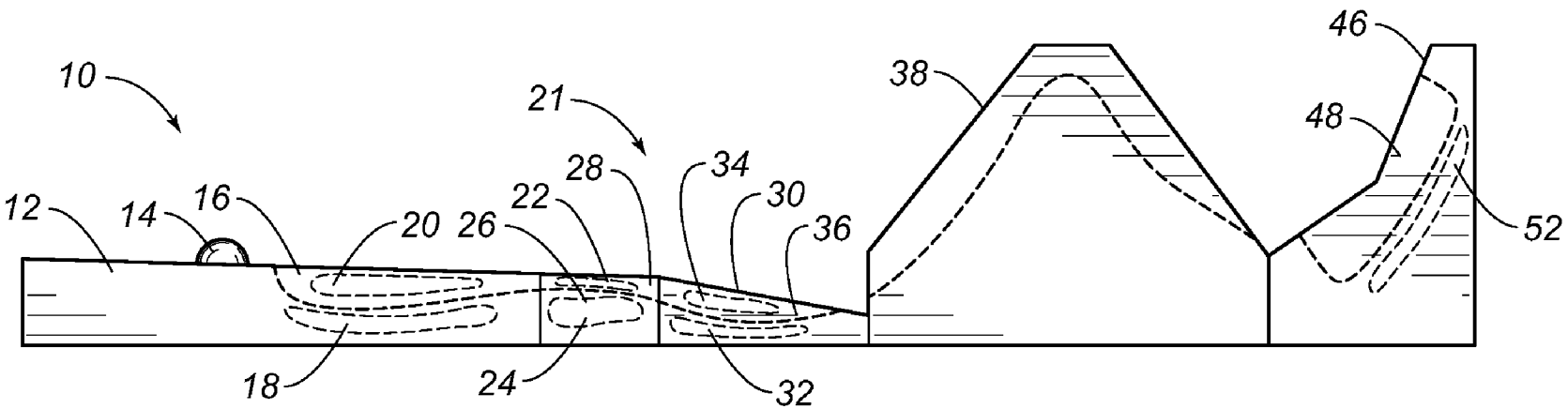
FIG. 3 shows a side cross-sectional view of the external immobilizer of the present invention.

Referring to FIG. 3, there is shown a side cross-sectional view of the external immobilizer 10 of the present invention. The bottom bladder 18 of the torso section 12 is located below the upper torso molding 16. The side bladder 20 of the torso section 12 is located on the side of the upper torso molding 16. Thus, the bottom bladder 18 is located below the side bladder 20. Similarly, the bottom bladder 24 of the lower back section 22 is located below the lower torso molding 28. The side bladder 26 is located on the side of the lower torso molding 28. Thus, the bottom bladder 24 is located below the side bladder 26. Similarly still, the bottom bladder 32 of the buttocks section 30 is located under the buttocks molding 36. The side bladder 34 is located on the side of the buttocks molding 36. Thus, the bottom bladder 32 is located below the side bladder 30. The bladder 52 is located under the foot molding 48 of the foot section 46.

The present invention is also a method of immobilizing a patient for cancer treatment. First, a mat structure is formed which has contoured moldings formed therein and a plurality of inflatable bladders under the surface of the contoured moldings. Each of the inflatable bladders has an actuating device connected thereto. Next, the actuating devices are connected through fluid supply lines to a fluid supply device. Finally, a patient is placed on the mat structure and the inflatable bladders are selectively inflated so as to fix the patient in the desired position. Additionally, the actuating devices and the fluid supply device are connected to a computer which controls the inflation of the bladders.

The foregoing disclosure and description of the invention is illustrative and explanatory thereof. Various changes in the details of the described system and method can be made within the scope of the appended claims without departing from the true spirit of the invention. The present invention should only be limited by the following claims and their legal equivalents.

I claim:

1. An external immobilizer for use in cancer treatment, said immobilizer comprising:

a) a mat structure having contoured moldings formed therein shaped to receive a patient body, said contoured moldings having sides and a bottom;

b) a plurality of bladders comprising side bladders on said sides and bottom bladders on said bottom; and c) a plurality of inflating means to selectively and independently inflate said plurality of bladders;

wherein said plurality of inflating means controlled by a computer that selectively and independently inflates one or more of said plurality of bladders to fix the patient in a desired position and to compensate for patient movement during external beam radiation therapy.

2. The immobilizer of claim 1, wherein said contoured moldings comprise a foot section connected to a knee section connected to a pelvic section wherein said knee section is elevated, and wherein each section comprises a plurality of bladders comprising side bladders on said sides and bottom bladders on said bottom.

3. The immobilizer of claim 1, wherein said contoured moldings comprise a knee section having a first inclined surface and a second inclined surface extending toward an upper section thereof.

4. The immobilizer of claim 1, wherein said contoured moldings comprise a pelvic section connected to a torso section, and wherein each section comprises a plurality of bladders comprising side bladders on said sides and bottom bladders on said bottom.

5. The immobilizer of claim 1, said inflating means comprising a plurality of actuating devices connected to said plurality of bladders, a plurality of fluid lines connected to said plurality of actuating devices, and a fluid supply device connected to said plurality of fluid lines at an end remote from said plurality of actuating devices.

6. A method of immobilizing a patient for cancer treatment, comprising placing a patient into the immobilizer of claim 1, inflating said plurality of bladders so as to fix said patient in a position, and coordinating the inflation and deflation of said plurality of inflatable bladders positioned below the torso of said patient to compensate for patient breathing.

7. The immobilizer of claim 1, wherein said contoured moldings comprise a foot section connected to a leg and knee section connected to a pelvic section connected to a torso section, wherein said leg and knee section is elevated, wherein each section comprises a plurality of bladders comprising side bladders on said sides and bottom bladders on said bottom, and said inflating means comprising: a plurality of actuating devices connected to said plurality of bladders and a plurality of fluid lines connected to said plurality of actuating devices, and a fluid supply device connected to said plurality of fluid lines at an end remote from said plurality of actuating devices.

8. A method of immobilizing a patient for cancer treatment, comprising placing a patient into the immobilizer of claim 7, inflating said plurality of bladders so as to fix said patient in a position, and coordinating the inflation and deflation of said plurality of inflatable bladders of said patient to compensate for patient breathing.

* * * * *